US005350883A

United States Patent [19]

Kitamura et al.

[11] Patent Number: 5,350,883

[45] Date of Patent: Sep. 27, 1994

[54] ELECTRONIC MUSICAL INSTRUMENT WITH A PEDAL

[75] Inventors: Minoru Kitamura; Makoto Iwabayashi, both of Hamamatsu, Japan

[73] Assignee: Yamaha Corporation, Hamamatsu, Japan

[21] Appl. No.: 914,997

[22] Filed: Jul. 16, 1992

Related U.S. Application Data

[63] Continuation of Ser. No. 436,486, Nov. 14, 1989, abandoned.

[30] Foreign Application Priority Data

Nov. 15, 1988 [JP] Japan ..... 63-286746

[51] Int. Cl.[5] ..... G10H 1/32

[52] U.S. Cl. ..... 84/644; 84/670; 84/721; 84/746; 84/DIG. 25

[58] Field of Search ..... 318/551; 84/644, 670, 84/721, 746, 471, 483.1, 483.2, DIG. 25; 200/86.5

[56] References Cited

U.S. PATENT DOCUMENTS

| | | | |
|---|---|---|---|
| 3,499,094 | 3/1970 | Hashino | 84/706 X |
| 3,626,078 | 12/1971 | Sekiguchi | 84/737 |
| 4,030,397 | 6/1977 | Nelson | 84/707 X |
| 4,491,050 | 10/1985 | Franzmann | 84/DIG. 25 |
| 4,526,079 | 7/1985 | Oguri | 84/633 |
| 4,655,113 | 4/1987 | Bunger et al. | 84/DIG. 12 |
| 4,658,640 | 4/1987 | Aitken et al. | 84/629 |
| 4,719,834 | 1/1987 | Hall et al. | 84/652 |
| 4,882,969 | 11/1989 | Ricca | 84/487 |
| 4,909,119 | 3/1990 | Morokuma | 84/702 |
| 5,239,691 | 8/1993 | Retzer et al. | 455/89 |
| 5,241,130 | 8/1993 | Shibukawa | 84/659 |

FOREIGN PATENT DOCUMENTS

| | | |
|---|---|---|
| 59-13657 | 4/1984 | Japan . |
| 61-172192 | 8/1986 | Japan . |

*Primary Examiner*—William M. Shoop, Jr.
*Assistant Examiner*—Brian Sircus
*Attorney, Agent, or Firm*—Spensley Horn Jubas & Lubitz

[57] ABSTRACT

An electronic piano with a pedal, which can control various parameters by the pedal. The electronic piano has a mode switch for selecting a mode, and the electronic piano switches parameters to be controlled by the pedal according to the selected mode by the mode switch. The pedal can provide not one but a variety of parameter control functions. Further, an electronic piano with first and second pedals, wherein a relationship between the up/down operation of the first pedal and an increase/decrease in parameter to be controlled is set to be opposite to a relationship between the up/down operation of the second pedal and the increase/decrease in parameter to be controlled.

12 Claims, 10 Drawing Sheets

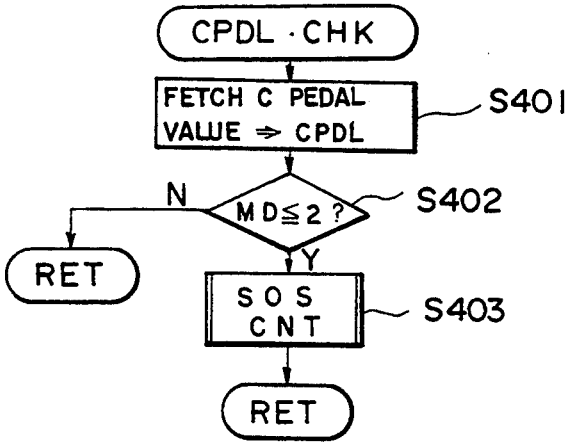
FIG. 7
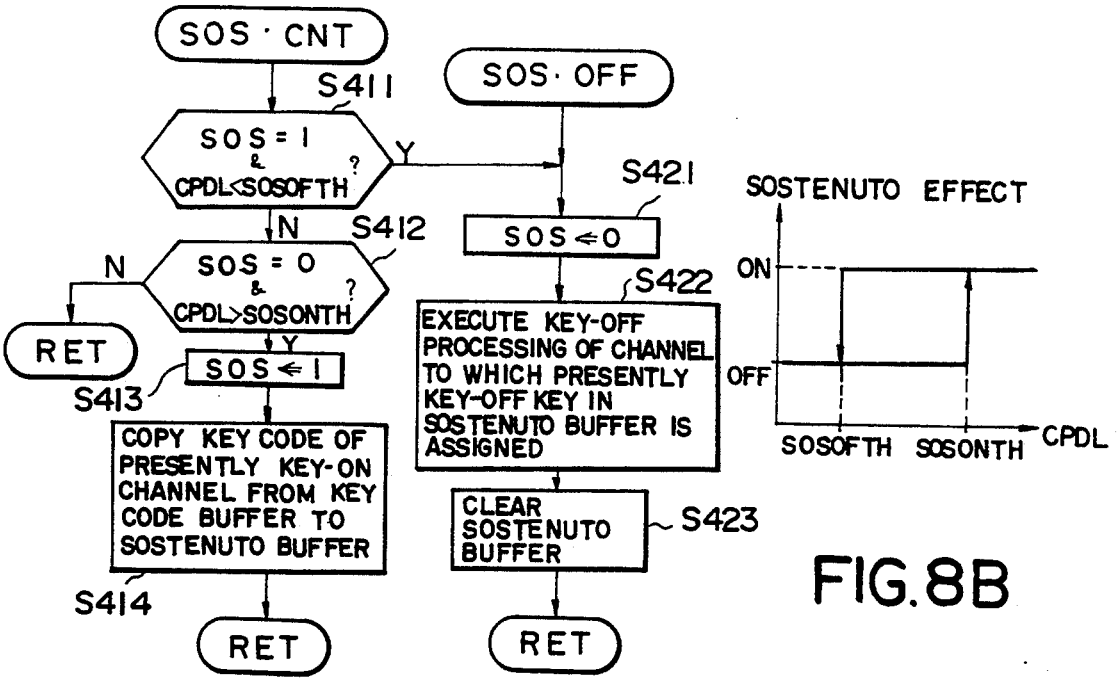
FIG.8B
FIG.8A

ELECTRONIC MUSICAL INSTRUMENT WITH A PEDAL

This is a continuation of application Ser. No. 07/436,486 filed on Nov. 14, 1989, now abandoned.

BACKGROUND OF THE INVENTION

1. Field of the Invention

The present invention relates to an electronic piano with a pedal, which can control various parameters associated with a tempo, rhythm, soft, sostenuto, and the like by the pedal of the electronic piano.

2. Description of the Prior Art

In recent years, electronic pianos having functions equivalent to an acoustic piano have been developed and are commercially available. An electronic piano of this type is provided with the same pedal as a soft pedal of an acoustic piano. When this pedal is operated by a foot, a tone volume, a tone color, and the like of a musical tone can be controlled.

An electronic musical instrument which can finely control a tone volume, a tone color, and the like of a musical tone in accordance with an operation state of a pedal is disclosed in Japanese Patent Laid-Open (Kokai) No. Sho 61-172192. A circuit for effectively variably controlling attenuation characteristics of a musical tone upon operation of a sostenuto pedal or a damper pedal is disclosed in Japanese Utility Model Publication No. Sho 59-13657.

However, in these prior arts, one pedal has only one function, and cannot provide a plurality of kinds of control functions. For example, the pedal cannot perform multi-stage control necessary when a tempo or the like is controlled.

SUMMARY OF THE INVENTION

It is, therefore, an object of the present invention to provide an electronic piano with a pedal which can perform various control operations with one pedal, and can realize multi-stage control by the pedal.

According to the present invention, the electronic piano with the pedal switches parameters to be controlled by the pedal using a mode switch.

Thus, the pedal can provide not only one control function but a variety of parameter control functions.

When the pedal is commonly used in both multistage control and ON/OFF control or when a relative change in present parameter from a preset value is controlled by the pedal, available and flexible control can be attained.

Furthermore, two pedals may be used to perform the following control. When a first pedal is depressed, a predetermined parameter value is incremented, and when a second pedal is depressed, the predetermined parameter value is decremented. In this manner, a threshold value used when the parameter is incremented/decremented can be changed in parameter incrementing and decrementing modes, resulting in convenience.

BRIEF DESCRIPTION OF THE DRAWINGS

FIG. 7 is a flow chart for explaining an operation of a subroutine CPDLCHK;

FIG. 8A is a flow chart for explaining operations of subroutines SOSCNT and SOSOFF;

FIG. 8B is a graph for explaining a sostenuto effect;

DETAILED DESCRIPTION OF THE PREFERRED EMBODIMENT

An embodiment of the present invention will now be described with reference to the accompanying drawings.

Figure 1:
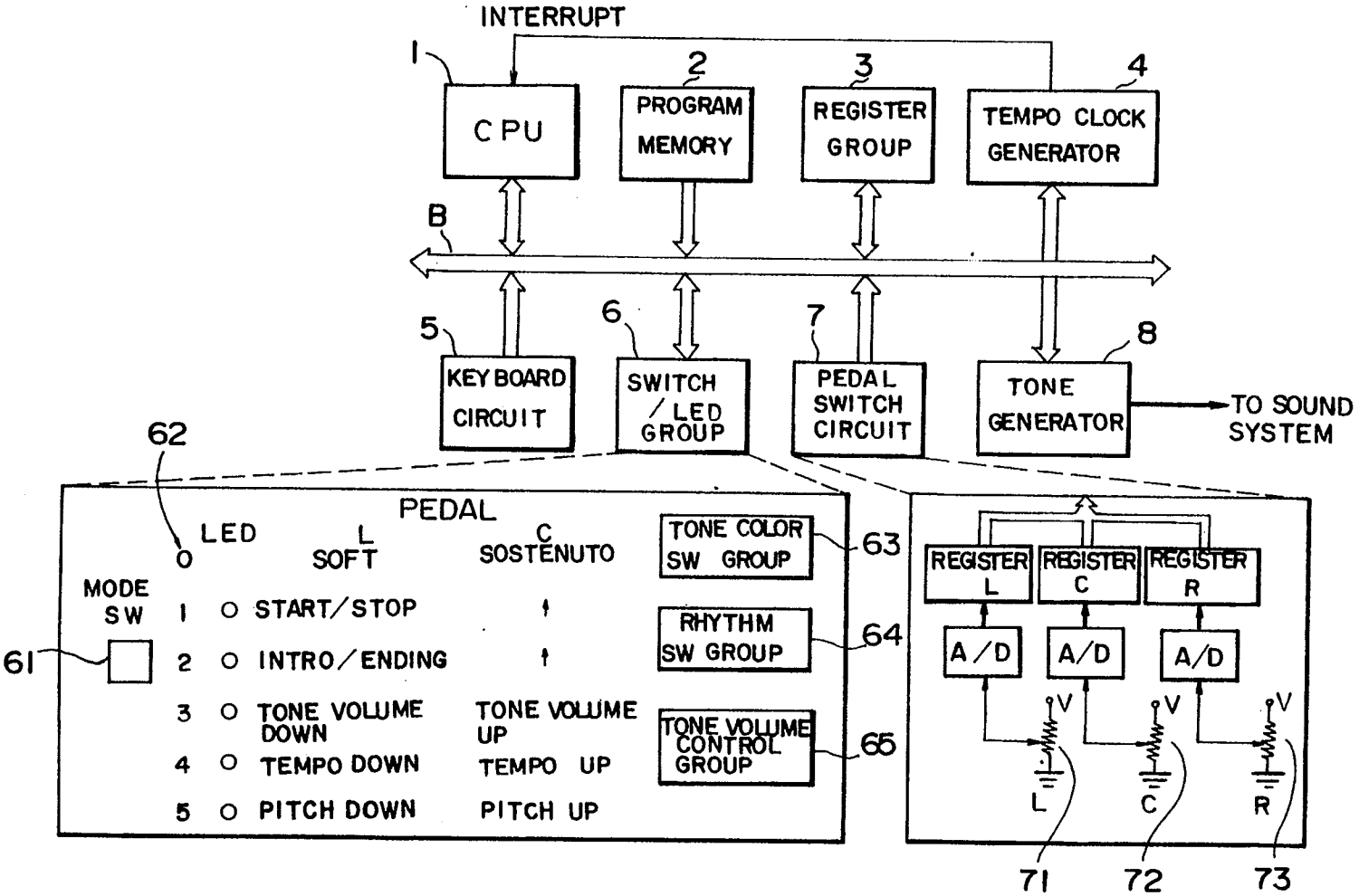
FIG. 1 is a block diagram showing an arrangement of an electronic piano with a pedal according to an embodiment of the present invention.

FIG. 1 is a block diagram showing an arrangement of an electronic piano with a pedal according to the embodiment of the present invention. Reference numeral 1 denotes a CPU (central processing unit); 2, a program memory for storing a program operated in the CPU 1; 3, a register group for storing various data; 4, a tempo clock generator; and 5, a keyboard circuit constituted by key switches corresponding to a plurality of keyboard keys and their peripheral circuits.

Reference numeral 6 denotes a switch/LED group which includes a mode switch 61, an LED group 62 indicating roles of an L (left) pedal and a C (central) pedal, a tone color switch group 63, a rhythm switch group 64, and a tone volume control group 65. Note that the electronic piano of this embodiment has an R (right) pedal in addition to the L and C pedals. In this embodiment, the R pedal is used as a damper (sustain) pedal, and the L and C pedals are multi-functional. The rhythm switch group 64 includes a start/stop switch, an intro/ending switch, a rhythm select switch, a tempo volume control, and the like.

Reference numeral 7 denotes a pedal switch group which includes a variable resister 71 which is operated in accordance with an operation of the L pedal, a variable resister 72 corresponding to the C pedal, a variable resister 73 corresponding to the R pedal, analog-to-digital(A/D) converters for converting analog values corresponding to depression amounts(value of resistance) of the variable resisters 71, 72, and 73 into digital data, and registers L, C, and R for storing the converted digital data. The registers L, C, and R and respectively 5-bit registers, and the depression amount of each pedal is expressed in 32 levels (0 to 31), Reference numeral 8 denotes a tone generator for forming a musical tone signal on the basis of a musical tone parameter or the like supplied through a bus line B and supplying the signal to a sound system.

Figure 2:
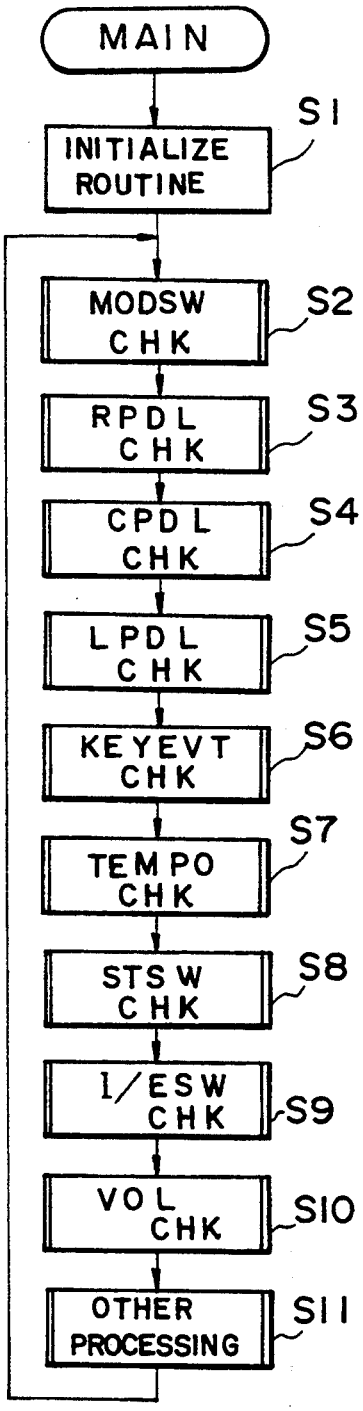
FIG. 2 is a flow chart of a main routine showing the processing of a CPU 1.

FIG. 2 is a flow chart of the main routine showing the processing of the CPU 1. The operation of the electronic piano of this embodiment will be described below with reference to FIG. 2.

In step S1, flags, registers, and the like are initialized.

Figure 4:
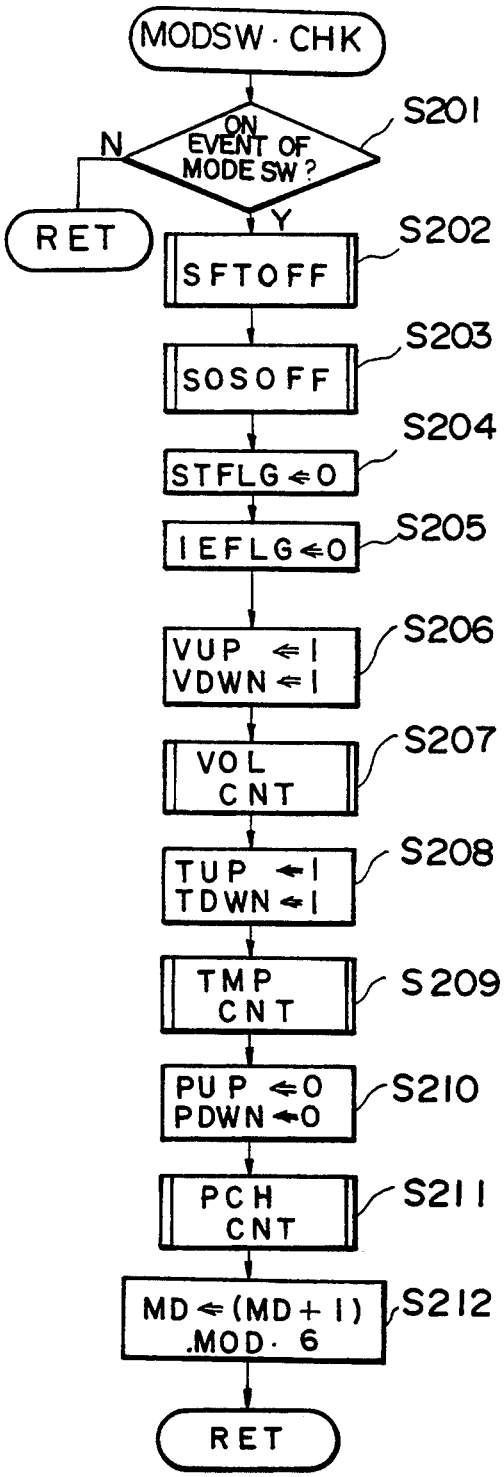
FIG. 4 is a flow chart for explaining an operation of a subroutine MODSWCHK.

After the initialization, processing in steps S2 to S11 are repetitively executed. In step S2, a subroutine MODSWCHK shown in the flow chart of FIG. 4 is executed. In this subroutine, it is checked if the mode switch is depressed, and each time the mode switch is depressed, a mode is updated(incremented) by one.

Figure 5A:
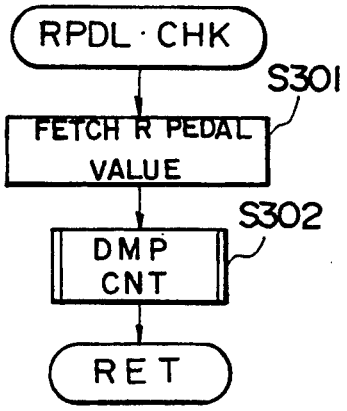
FIG. 5A is a flow chart for explaining an operation of a subroutine RPDLCHK.
Figure 5B:
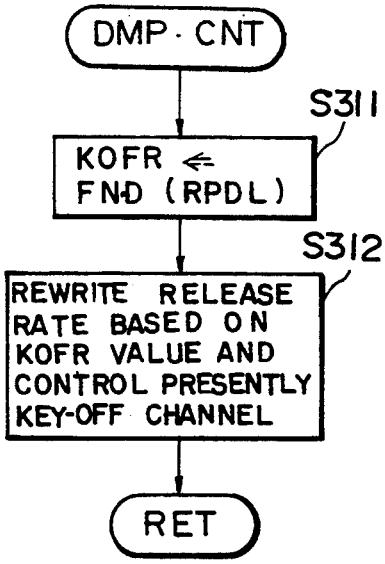
FIG. 5B is a flow chart for explaining an operation of a subroutine DMPCNT.

In step S3, a subroutine RPDLCHK shown in the flow chart of FIG. 5A is executed. In this subroutine, the state of the R pedal is checked to realize a damper or damping function.

In step S4, a subroutine CPDLCHK shown in the flow chart of FIG. 7 is executed. In this subroutine, the state of the C pedal is checked to perform sostenuto processing.

Figure 9:
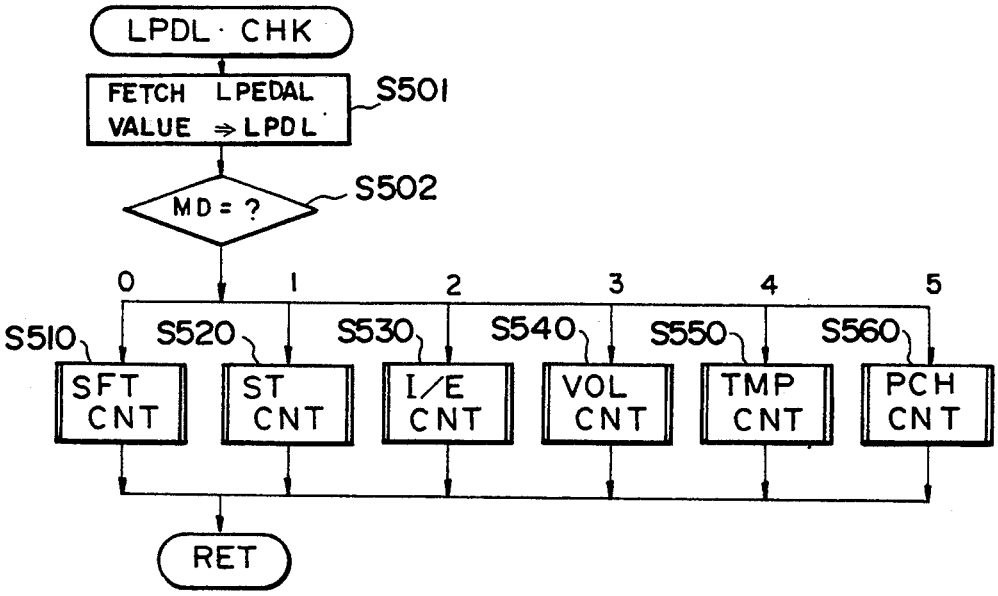
FIG. 9 is a flow chart for explaining an operation of a subroutine LPDLCHK.

In step S5, a subroutine LPDLCHK shown in the flow chart of FIG. 9 is executed. In this subroutine, the state of the L pedal is checked, and a predetermined operation is performed in accordance with the selected mode.

Figure 16:
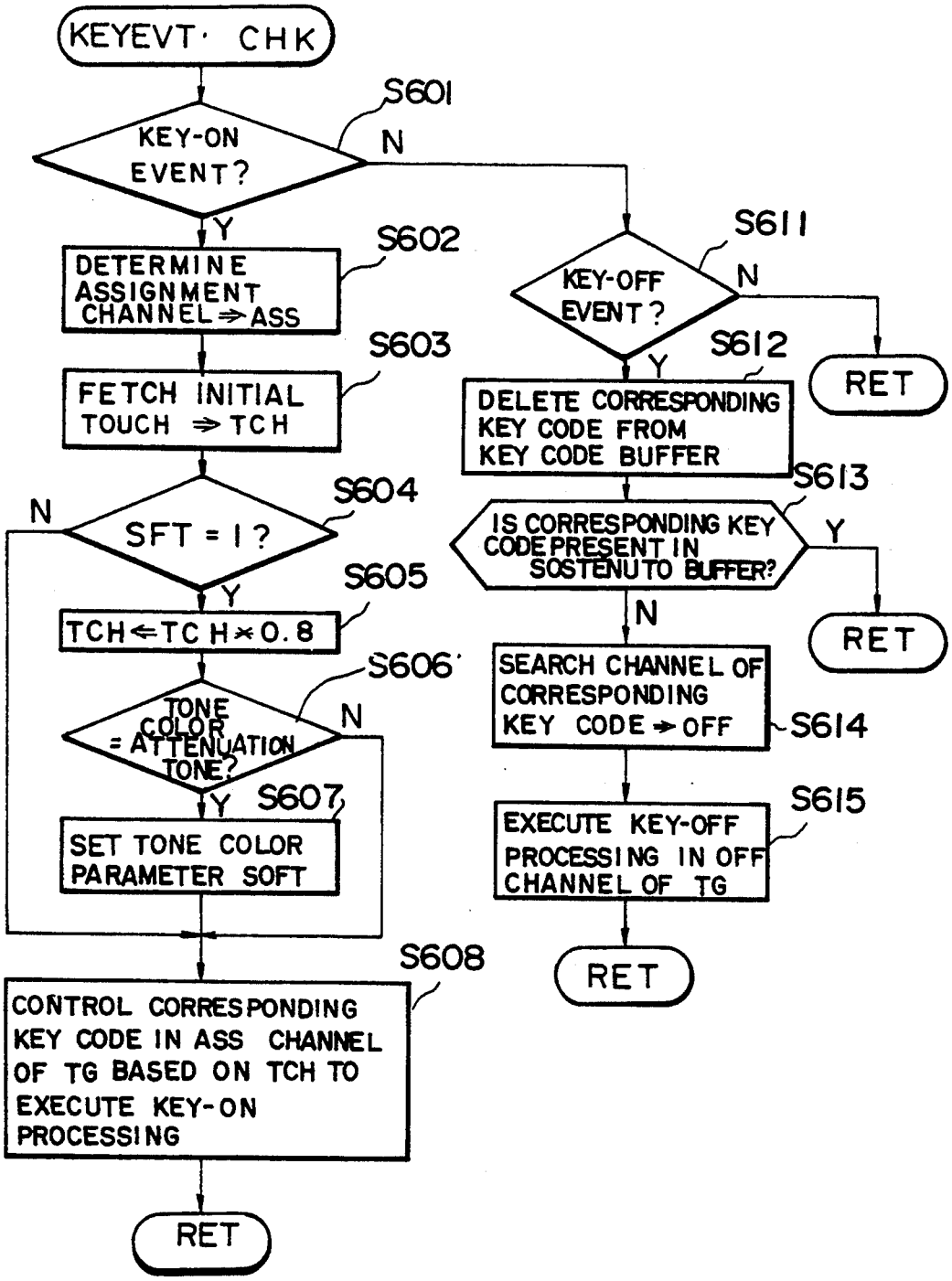
FIG. 16 is a flow chart for explaining an operation of a subroutine KEYEVTCHK.

In step S6, a subroutine KEYEVTCHK shown in the flow chart of FIG. 16 is executed. In this subroutine, the presence/absence of a key-on or key-off event is checked, and key-on or key-off processing is performed.

Figure 14A:
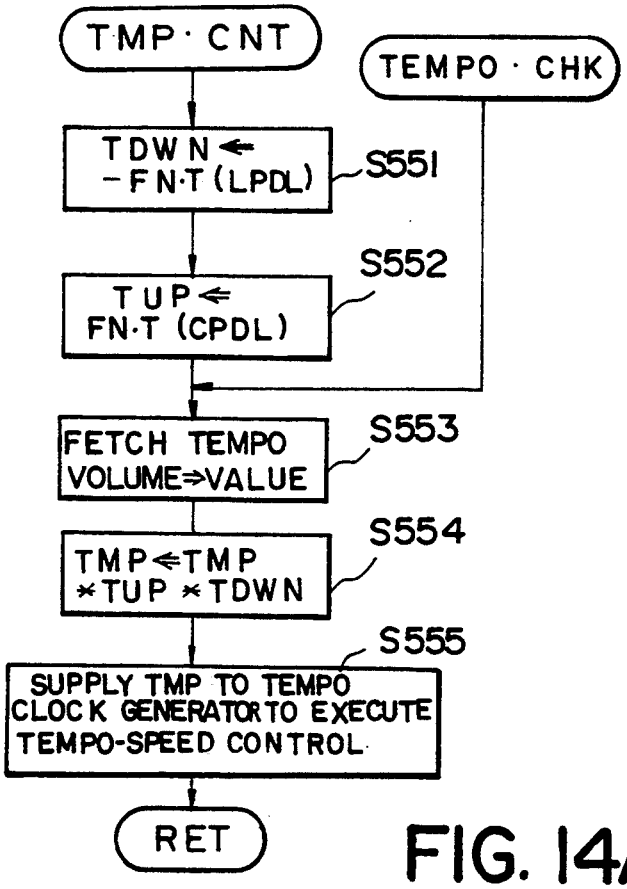
FIG. 14A is a flow chart for explaining operations of subroutines TMPCNT and TEMPOCHK.

In step S7, a subroutine shown in the flow chart of FIG. 14A is executed. In this subroutine, the position of the tempo volume control is checked to perform tempo-speed control.

Figure 11:
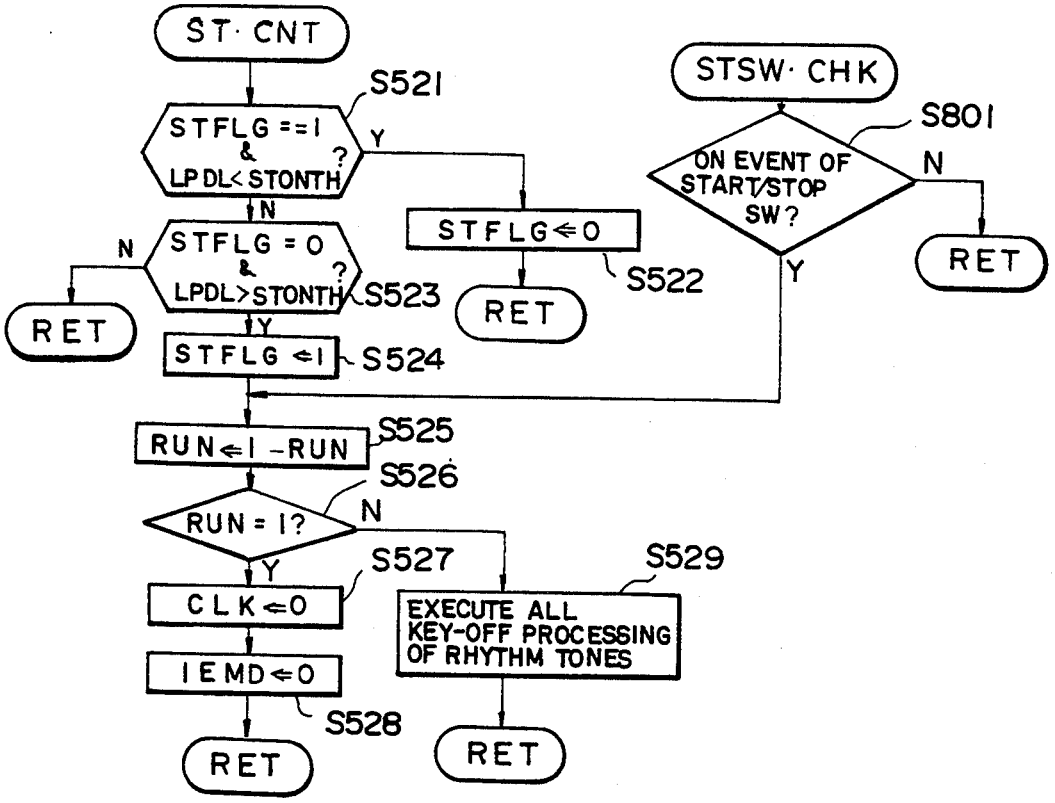
FIG. 11 is a flow chart for explaining operations of subroutines STCNT dand STSWCHK.

In step S8, a subroutine STSWCHK shown in the flow chart of FIG. 11 is executed. In this subroutine, the state of the start/stop switch on a panel is checked to perform a start/stop operation.

Figure 12:
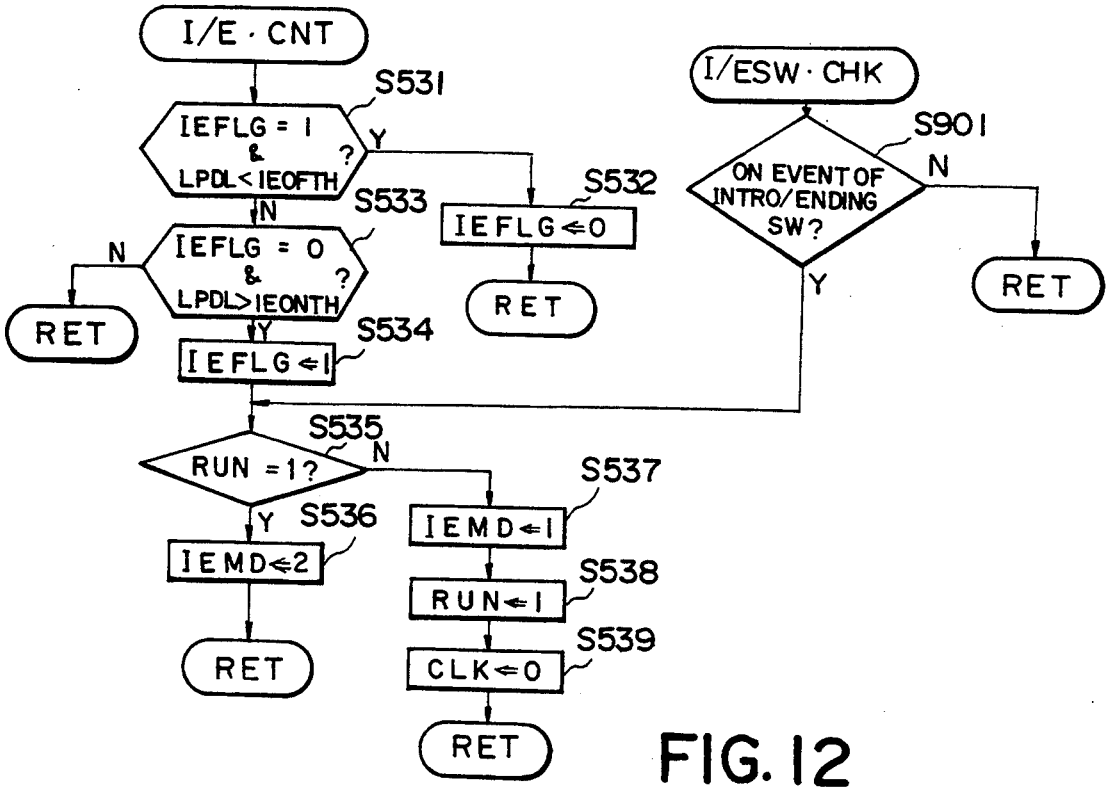
FIG. 12 is a flow chart for explaining operations of subroutines I/ECNT and I/ESWCHK.

In step S9, a subroutine I/ESWCHK shown in the flow chart of FIG. 12 is executed. In this subroutine, the state of the intro/ending switch on the panel is checked to perform a predetermined operation.

Figure 13A:
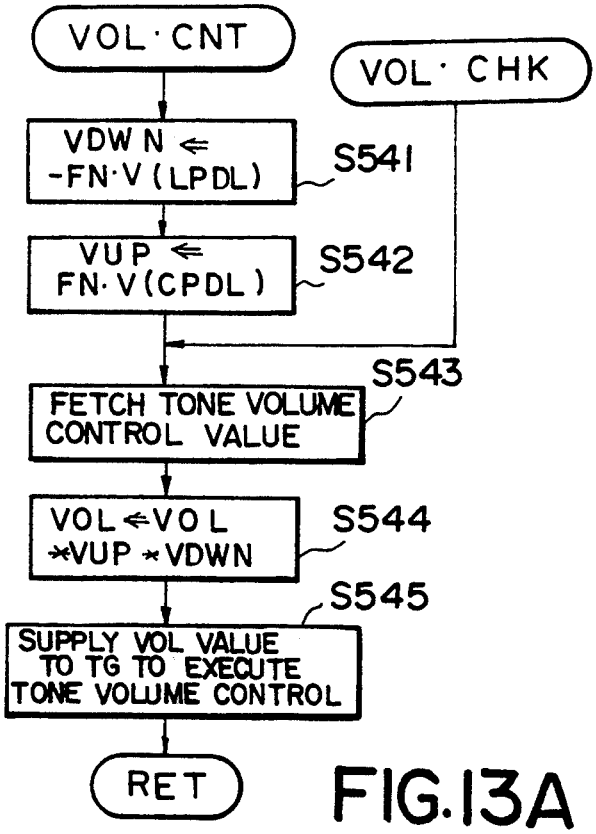
FIG. 13A is a flow chart for explaining operations of subroutines VOLCNT and VOLCHK.

In step S10, a subroutine VOLCHK shown in the flow chart of FIG. 13A is executed. In this subroutine, the state of the tone volume control on the panel is checked to perform tone volume control.

Finally, in step S11, other processing operations are performed, and the flow returns to step S2. The above-mentioned subroutines will be described in detail later.

Figure 3:
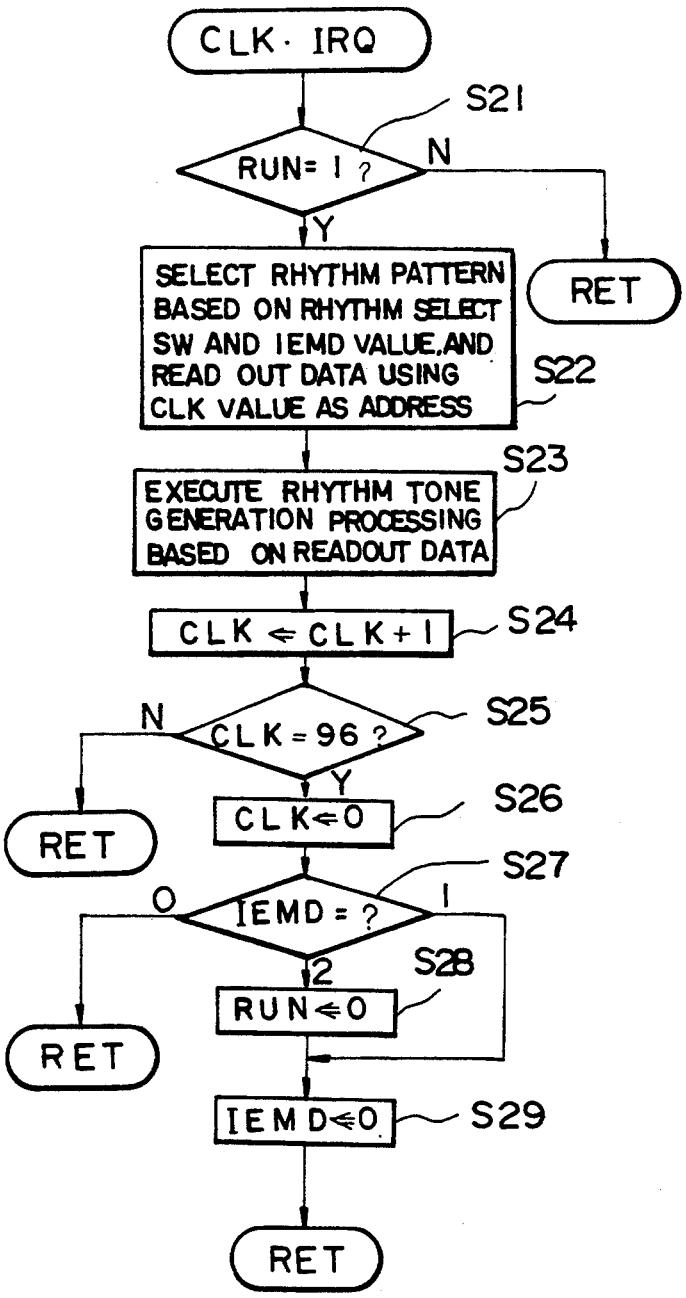
FIG. 3 is a flow chart for explaining an operation of a subroutine CLKIRQ.

An interrupt processing routine CLKIRQ will be described below with reference to the flow chart of FIG. 3. An interrupt is made in response to an interrupt signal which is output from the tempo clock generator 4 (FIG. 1) to the CPU 1 at a predetermined time interval. In this case, the CPU 1 executes the subroutine CLKIRQ shown in FIG. 3.

In step S21, a RUN flag is checked. The RUN flag indicates whether or not an auto rhythm is being executed. When the RUN flag is "0" (OFF), it indicates that the auto rhythm is not executed; when it is "1", it indicates that the auto rhythm is being executed. If the RUN flag is "0", interrupt processing need not be performed, and the flow returns to the calling routine. If the RUN flag is "1", a rhythm pattern is selected on the basis of values of the rhythm select switch (a switch for selecting types of rhythm such as waltz, rock'n roll, and the like) and an intro/ending mode IEMD, and rhythm tone data is read out using a value of a clock CLK as an address in step S22. The intro/ending mode IEMD is a register indicating a state of the auto rhythm, and takes the following values:

0: normal pattern
1: intro mode
2: ending mode

In step S23, a rhythm tone is generated on the basis of the readout rhythm tone data. In step S24, the clock CLK is incremented. It is then checked in step S25 if the clock CLK reaches 96. If N in step S25, the flow returns to the calling routine. However, if Y in step S25, the clock CLK is cleared to zero in step S26, and the intro/ending mode IEMD is checked in step S27. If the mode IEMD is "0", i.e., indicates the normal pattern, the flow returns to the calling routine. However, if the mode IEMD is "1", i.e., indicates the intro mode, this means that an intro is just finished. Therefore, in step S29, "0" indicating the normal pattern is set in the mode IEMD, and the flow returns to the calling routine. If the mode IEMD is "2", i.e., indicates the ending mode, this means that an ending part is just finished. Thus, in order to stop the auto rhythm, the RUN flag is set to "0" in step S28. In step S29, the value of the mode IEMD is set to "0", and the flow returns to the calling routine.

The processing in the mode switch check subroutine MODSWCHK will be described below with reference to the flow chart of FIG. 4. In this embodiment, six modes are available. Each mode corresponds to a value of a register MD. Table 1 below summarizes control functions of the L and C pedals in the respective modes.

TABLE 1

| MD Value | L Pedal | C Pedal |
|---|---|---|
| 0 | Soft | Sostenuto |
| 1 | Start/Stop | Sostenuto |
| 2 | Intro/Ending | Sostenuto |
| 3 | Tone Volume Down | Tone Volume Up |
| 4 | Tempo Down | Tempo Up |
| 5 | Pitch Down | Pitch Up |

The presently set mode is indicated by an 0N LED of the LEDs 62 shown in FIG. 1, and this mode can be advanced by one upon each depression of the mode switch 61. When the switch 61 is depressed when MD=5, the mode is returned to MD=0.

Referring to FIG. 4, in this subroutine MODSWCHK, it is checked in step S201 if the mode switch 61 on the panel is depressed. If no ON event of the mode switch 61 is detected, the flow returns to the main routine. If an ON event of the switch 61 is detected, the following processing is performed to advance the mode by one and to change the roles of the L and C padals. In step S202, a subroutine SFTOFF is called, and in step S203, a subroutine SOSOFF is called. In the subroutine SFTOFF, a soft effect is turned off. In the subroutine SOSOFF, a sostenuto effect is turned off.

These subroutines will be described in detail later with reference to FIGS. 8 and 10.

In step S204, a start/stop flag STFLG is cleared to zero. In step S205,, an intro/ending flag IEFLG is cleared to zero. The start/stop flag STFLG and the intro/ending flag IEFLG have an initial value of "0", and respectively take the following values:

STFLG:

1 (ON) in start state of auto rhythm 0 (OFF) in stop state of auto rhythm

IEFLG:

1 (ON) in intro/ending state 0 (OFF) in other states

In step S206, a tone volume up coefficient VUP and a tone volume down coefficient VDWN are initialized to "1". In step S207, a subroutine VOLCNT shown in the flow chart of FIG. 13A is called. In the subroutine VOLCNT, a tone volume is controlled as instructed in accordance with a change in tone volume according to depression amounts of the L and C pedals in addition to the preset value of the tone volume control.

In step S208, a tempo up coefficient TUP and a tempo down coefficient TDWN are initialized to "1". In step S209, a subroutine TMPCNT shown in the flow chart of FIG. 14A is called. In the subroutine TMPCNT, a tempo is controlled as instructed in accordance with a change in tempo according to depression amounts of the L and C pedals in addition to the preset value of the tempo volume control.

Figure 15B:
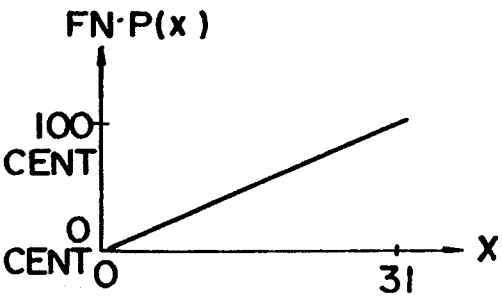
FIG. 15B ms a graph for explaining a function FNP.
Figure 15A:
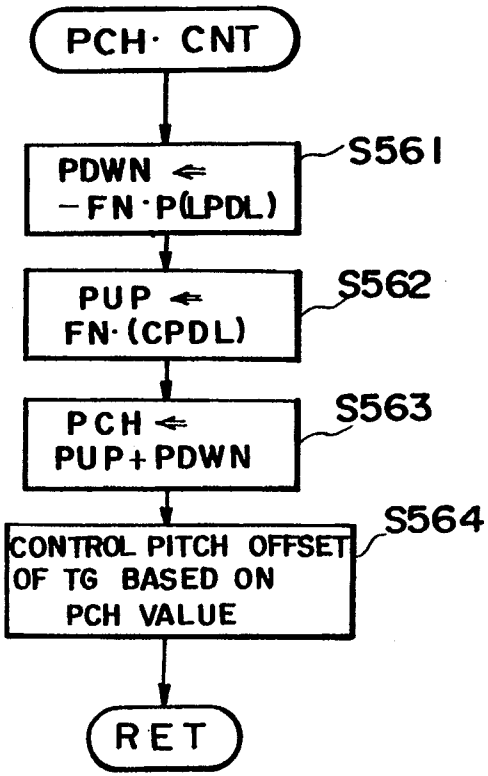
FIG. 15A is a flow chart for explaining an operation of a subroutine PCHCNT.

In step S210, a pitch up register PUP and a pitch down register PDWN are initialized to "0". In step S211, a subroutine PCHCNT shown in the flow chart of FIG. 15A is called. In the subroutine PCHCNT, a pitch is controlled in accordance with the depression amounts of the L and C pedals.

Finally, in step S212, for the mode value MD, (MD+1).MOD.6 is calculated, and the calculated value is set in the register MD. In this processing, the value of the mode MD is incremented by one.

The subroutine RPDLCHK will be described below with reference to FIG. 5A. This subroutine is called in step S3 in the main routine shown in FIG. 2.

Figure 6A:
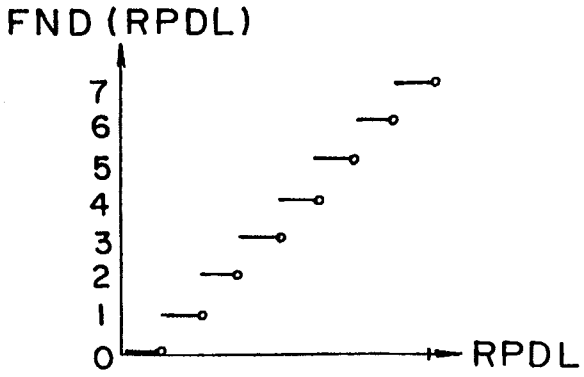
FIG. 6A to 6C are graphs showing a function FND and the like used in the subroutine RPDLCHK.
Figure 6B:
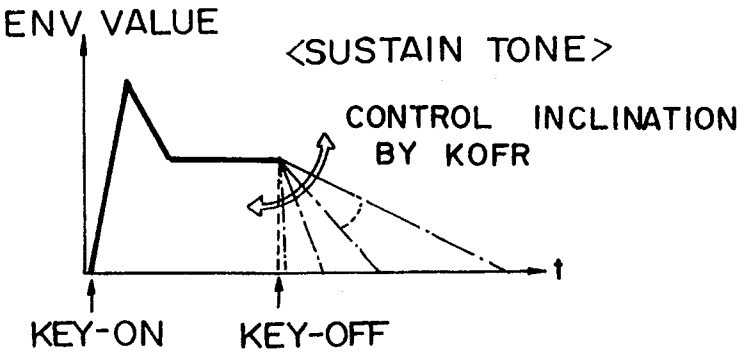
Figure 6C:
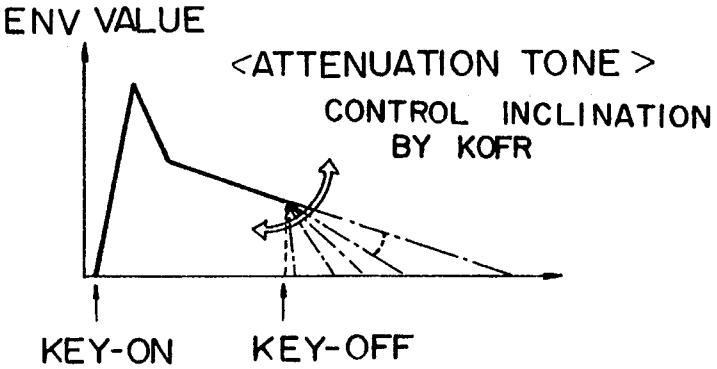

In step S301, an R pedal value indicating the depression amount of the R pedal is fetched, and is set in a fetching register RPDL. Then, a subroutine DMPCNT is called. In the subroutine DMPCNT, in step S311, FND(RPDL) is calculated in accordance with the graph shown in FIG. 6A, and the calculated value is set in a register KOFR. More specifically, the depression amount of the R pedal is classified into 8 levels, and its value (0 to 7) is represented by KOFR. In step S312, a release rate is rewritten based on the value of the register KOFR to control a presently key-off channel. More specifically, as shown in FIGS. 6B and 6C, an inclination of a sustain tone or an attenuation tone after key-off is controlled in accordance with the depression amount of the R pedal. Thus, the R pedal can serve as a damper pedal.

The subroutine CPDLCHK will be described below with reference to FIG. 7. This subroutine is called in step S4 in the main routine shown in FIG. 2.

In step S401, a C pedal value indicating then depression amount of the C pedal is fetched, and is set in a register CPDL. It is checked in step S402 if the mode value MD is 2 or less. If Y in step S402, since the sostenuto function is assigned to the C pedal, a subroutine SOSCNT is called in step S403 to perform sostenuto control. However, if N in step S402, the flow returns to the main routine.

The subroutine SOSCNT called from the subroutine CPDLCHK will be described below with reference to FIG. 8A.

It is checked in step S411 if a sostenuto flag SOS is "1" (indicating that the sostenuto effect is ON) and the C pedal value CPDL is smaller than a sostenuto OFF threshold SOSOFTH. If Y in step S411, the flow advances to step S421; otherwise, it is checked in step S412 if the sostenuto flag SOS is "0" (indicating that the sostenuto effect is OFF) and the C pedal value CPDL is larger than a sostenuto ON threshold SOSONTH. If N if step S412, the flow returns to the calling routine.

The checking operations in steps S411 and S412 are performed to ON/OFF-control the sostenuto effect on the basis of hysteresis control shown in FIG. 8B. More specifically, if the sostenuto effect is already ON, the sostenuto effect is set OFF when the C pedal value CPDL becomes smaller than the predetermined threshold SOSOFTH. Contrary to this, if the sostenuto effect is already OFF, the sostenuto effect is set ON when the C pedal value CPDL exceeds the predetermined threshold SOSONTH.

If Y in step S412, the sostenuto flag SOS is set to be "1" (ON) in step S413. In step S414, a key code of a presently key-on channel is copied from a key code buffer to a sostenuto buffer, and the flow then returns to the calling routine.

If Y in step S411, sostenuto effect OFF processing starting from step S421 is executed. In step S421, the sostenuto flag SOS is set to "0" (OFF). In step S422, key-off processing of a channel to which a presently key-off key present in the sostenuto buffer is assigned is performed. In step S423, the sostenuto buffer is cleared, and the flow returns to the calling routine.

Note that the subroutine SOSOFF shown in FIG. 8A is called from the mode switch check subroutine MODSWCHK shown in FIG. 4 and performs sostenuto OFF processing in steps S421 to S423.

The subroutine LPDLCHK will be described below with reference to FIG. 9. This subroutine is called in step S5 of the main routine shown in FIG. 2.

In step S501, an L pedal value indicating the depression amount of the L pedal is fetched in step S501, and is set in a register LPDL. In step S502, the mode value MD is checked. Based on the mode value MD, a corresponding function is assigned to the L pedal. Therefore, the flow branches to steps S510 to S560 in accordance with the mode value MD to call the corresponding subroutine, and the flow then returns to the main routine.

The subroutines called from the subroutine LPDLCHK will be described below.

When the mode value MD is "0", since the L pedal has a soft function, the subroutine LPDLCHK calls a subroutine SFTCNT in step S510.

Figure 10A:
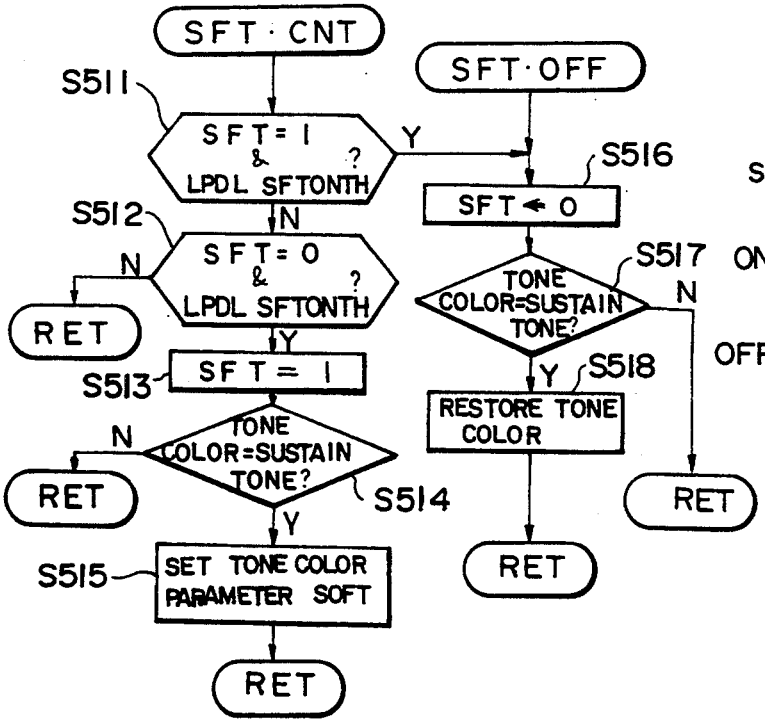
FIG. 10A is a flow chart for explaining operations of subroutines SFTCNT and SFTOFF.

Referring to FIG. 10A, in the subroutine SFTCNT, it is checked in step S511 if a soft flag SFT is "1" (indicating that a soft effect is ON) and the L pedal value LPDL is smaller than a soft OFF threshold SFTOFTH. If Y in step S511, the flow advances to step S516; otherwise, it is checked in step S512 if the soft flag SFT is "0" (indicating that the soft effect is OFF) and the L pedal value LPDL is larger than a soft ON threshold SFTONTH. If N in step S512, the flow returns to the calling routine.

Figure 10B:
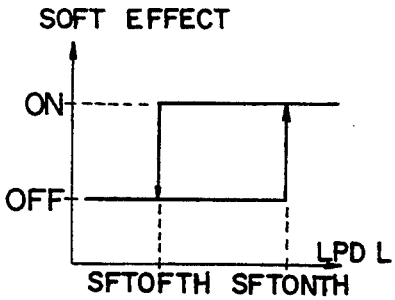
FIG. 10B is a graph for explaining a soft effect.

The checking operations in steps S511 and S512 are performed to ON/OFF-control the soft effect on the basis of hysteresis control shown in FIG. 10B. More specifically, if the soft effect is already ON, the soft effect is set OFF when the L pedal value LPDL becomes smaller than the predetermined threshold SFTOFTH. On the contrary, if the soft effect is already OFF, the soft effect is set ON when the L pedal value LPDL exceeds the predetermined threshold SFTONTH.

If Y in step S512, the soft flag SFT is set to "1" (ON) in step S513. It is then checked in step S514 if a tone color indicates a sustain tone. If Y in step S514, a tone color parameter is set to be a soft value, and the flow returns to the calling routine.

If Y in step S511, soft effect OFF processing starting from step S516 is executed. In step S516, the soft flag SFT is set to "0" (OFF). It is then checked in step S517 if a tone color indicates a sustain tone. If Y in step S517, the tone color is restored in step S518, and the flow returns to the calling routine. If the tone color indicates not a sustain tone but an attenuation tone, since no soft processing is required, the flow returns to the calling routine.

Note that the subroutine SFTOFF in FIG. 10A is called from the mode switch check subroutine MODSWCHK shown in FIG. 4, and performs soft effect OFF processing in steps S516 to S518.

If it is determined in step S502 in FIG. 9 that the mode value MD is "1", since the L pedal has a start/-stop function, the subroutine LPDLCHK calls a subroutine STCNT in step S520.

Referring to FIG. 11, in the subroutine STCNT, it is checked in step S521 if a start/stop flag STFLG is "1" (ON) and the L pedal value LPDL is smaller than a start/stop OFF threshold STOFTH. If Y in step S521, the flow advances to step S522. In step S522, the flag STFLG is cleared to zero, and the flow returns to the calling routine. If N in step S521, it is checked in step S523 if the start/stop flag STFLG is "0" (OFF) and the L pedal value LPDL is larger than the start/stop 0N threshold STONTH. If N in step S523, the flow returns to the calling routine. The checking operations in steps S521 and S523 are performed to perform hysteresis control described with reference to FIGS. 8B and 10B.

If Y in step S523, the start/stop flag STFLG is set to "1" (ON) in step S524. In step S525, the RUN flag is inverted. If it is determined in step S526 that the RUN flag is "1", the clock CLK and the intro/ending mode IEMD are cleared to zero in steps S527 and S528, and the flow returns to the calling routine. If it is determined in step S526 that the RUN flag is not "1" (i.e., is "0"), all-key OFF processing of rhythm tones is performed in step S529, and the flow returns to the calling routine.

Note that the subroutine STSWCHK in FIG. 11 is called from the main routine shown in FIG. 2. It is checked in step S801 if an ON event of the start/stop switch is detected. If Y in step S801, the start/stop control processing starting from step S525 is executed. If N in step S801, the flow returns to the main routine.

If it is determined in step S502 in FIG. 9 that the mode value MD is "2", since the L pedal has an intro/ending function, the subroutine LPDLCHK calls a subroutine I/ECNT in step S530.

Referring to FIG. 12, in the subroutine I/ECNT, it is checked in step S531 if an intro/ending flag IEFLG is "1" (ON) and the L pedal value is smaller than an intro/ending OFF threshold IEOFTH. If Y in step S531, the flow advances to step S532. In step S532, the flag IEFLG is cleared to zero, and the flow returns to the calling routine. If N in step S531, it is checked in step S533 if the intro/ending flag IEFLG is "0" (OFF) and the L pedal value LPDL is larger than an intro/ending ON threshold IEONTH. If N in step S533, the flow returns to the calling routine. The checking operations in steps S531 and S533 are performed to perform hysteresis control described with reference to FIGS. 8B and 10B.

If Y in step S533, the intro/ending flag IEFLG is set to "1" (ON) in step S534. It is then checked in step S535 if the RUN flag is ON. If Y in step S535, "2" as a value indicating an ending part is set in the intro/ending mode IEMD in step S536, and the flow returns to the calling routine. If it is determined in step S535 that the RUN flag is not "1" (i.e., is "0"), "1" as a value indicating an intro part is set in the intro/ending mode IEMD in step S537. In step S538, "1" is set in the RUN flag. In step S539, the clock CLK is cleared to zero, and the flow then returns to the calling routine.

A subroutine I/ESWCHK shown in FIG. 12 is called from the main routine shown in FIG. 2. In step S901, it is checked if an ON event of the intro/ending switch is detected. If Y in step S901, the intro/ending control processing starting from step S535 is executed. If N in step S901, the flow returns to the main routine.

If it is determined in step S502 in FIG. 9 that the mode value MD is "3", since the L pedal has a tone volume down function and the C pedal has a tone volume up function, the subroutine LPDLCHK calls a subroutine VOLCNT in step S540.

Figure 13B:
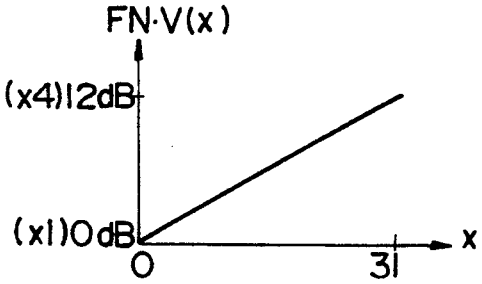
FIG. 13B is a graph for explaining a function FNV.

Referring to FIG. 13A, in the subroutine VOLCNT, -FNV(LPDL) is set in a tone volume down coefficient VDWN in step S541. In step S542, FNV(CPDL) is set in a tone volume up coefficient VUP. FNV is a function shown in the graph of FIG. 13B. Note that this function is not limited to an illustrated one. Various other functions suitable for tone volume control may be used.

In step S543, a preset value of the tone volume control on the panel is fetched, and is set in a register VOL. In step S544, VOL*VUP*VDWN is calculated, and the result is set in the register VOL. In step S545, the tone volume control value VOL is supplied to the tone generator to perform tone volume control. The tone volume control need only be performed when the value of the register VOL is changed. After step S545, the flow returns to the calling routine.

A subroutine VOLCHK shown in FIG. 13A is called from the main routine shown in FIG. 2. In this subroutine, the tone volume control processing starting from step S543 is performed.

If it is determined in step S502 in FIG. 9 that the mode value MD is "4", since the L pedal has a tempo down function and the C pedal has a tempo up function, the subroutine LPDLCHK calls a subroutine TMPCNT in step S550.

Figure 14B:
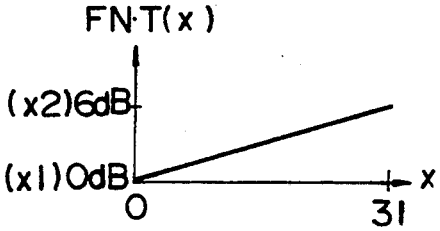
FIG. 14B is a graph for explaining a function FNT.

Referring to FIG. 14A, in the subroutine TMPCNT, -FNT(LPDL) is set in a tempo down coefficient TDWN in step S551. In step S552, FNT(CPDL) is set in a tempo up coefficient TUP. FNT is a function shown in the graph of FIG. 14B. Note that this function is not limited to an illustrated one. Various other functions suitable for tempo-speed control may be used.

In step S553, a preset value of the tempo volume control on the panel is fetched, and is set in a register TMP. In step S554, TMP*TUP*TDWN is calculated, and the result is set in the register TMP. In step S555, the tempo volume value TMP is supplied to the tempo clock generator to control a tempo speed. The tempo-speed control need only be performed when the value of the register TMP is changed. After step S555, the flow returns to the calling routine.

A subroutine TEMPOCHK in FIG. 14A is called from the main routine shown in FIG. 2. In this subroutine, tempo-speed control processing starting from step S553 is executed.

If it is determined in step S502 that the mode value MD is "5", since the L pedal has a pitch down function and the C pedal has a pitch up funbction, the subroutine LPDLCHK calls a subroutine PCHCNT in step S560.

Referring to FIG. 15A, in the subroutine PCHCNT, -FNP(LPDL) is set in a pitch down register PDWN in step S561. In step S562, FNP(CPDL) is set in a pitch up register PUP. FNP is a function shown in the graph of FIG. 15B. Note that this function is not limited to an illustrated one. Various other functions suitable for pitch control may be used. For example, a range is not limited to 100 cents but may be variable, e.g., 1,200 cents (one octave).

In step S563, PUP+PDWN is calculated, and the result is set in a pitch register PCH. In step S564, a pitch offset of the tone generator 8 is controlled in accordance with the value of the register PCH, and the flow returns to the calling routine. The pitch control need only be performed when the value of the register PCH is changed.

The key event check subroutine KEYEVTCHK called from the main routine shown in FIG. 2 will be described below.

It is checked in step S601 if there is a key-on event. If Y in step S601, an assignment channel is determined and is set in a register ASS in step S602. In step S603, initial touch data is fetched, and is set in a register TCH. It is checked in step S604 if the soft flag SFT is ON. If Y in step S604, 0.8 is multiplied with the touch data TCH to slightly decrease a tone volume in step S605. It is checked in step S606 if a tone color indicates an attenuation tone. If Y in step S606, a tone color parameter is set to be a soft value in step S607. If N in step S606, the flow advances from step S606 to step S608. If it is determined in step S604 that the soft flag is OFF, the flow also advances to step S608. In step S608, the corresponding key code (ON key) is controlled in a channel of the tone generator 8 indicated by the register ASS on the basis of the register TCH to perform key-on processing (tone generation processing). Thereafter, the flow returns to the main routine.

If N in step S601, it is checked in step S611 if there is a key-off event. If N in step S611, the flow returns to the main routine. If Y in step S611, the corresponding key code (OFF key) is deleted from the key code buffer in step S612. It is then checked in step S613 if the corresponding key code is present in the sostenuto buffer. If Y in step S613, the flow returns to the main routine. However, if N in step S613, a channel of the corresponding key code is searched, and the searched channel is set in a register OFF in step S614. In step S615, key-off processing is performed in an OFF channel of the tone generator 8, and the flow returns to the main routine.

In this embodiment, the soft effect is ON/OFF-controlled but may be multi-stage controlled. As other functions, a fill-in function or a tone-color change function may be added.

In tempo control, the depression amount of the pedal is correlated with a change in tempo. However, a tempo may be changed by a predetermnined amount every time the pedal is ON (e.g., when the L pedal is ON, tempo−1; when the R pedal is ON, tempo+1).

Pedal control may be performed by interrupt processing at predetermined time intervals. In addition, control may be made with an accompaniment.

As described above, according to the present invention, since parameters to be controlled by the pedal is switched by the mode switch, a variety of control operations are attained by one pedal. The pedal can be commonly used in multi-stage control and ON/OFF control.

What is claimed is:

1. An electronic musical instrument with a pedal, comprising:

a mode switch for selecting a mode from among plural modes;

parameter designating means for designating a parameter, to be controlled by said pedal, from among plural parameters according to said mode selected by said mode switch;

a depression sensing means coupled to the pedal for sensing a depression degree of the pedal and outputting an analog signal representing the detected depression degree;

analog-to digital converting means for converting the outputted analog signal into a digital signal corresponding thereto, the digital signal has a value; and control means for changing a value of the designated parameter in multi-stages by comparing the value of the digital signal with a plurality of threshold values when a first mode is selected by the mode switch, and for changing a value of the designated parameter in an on state and an off state by comparing the value of the outputted digital signal with one of the plurality of threshold values when a second mode is selected by the mode switch.

2. An electronic musical instrument according to claim 1, further comprising setting means for setting a parameter value in advance, and wherein said pedal controls a change value of the parameter relative to a present set parameter value by said setting means.

3. An electronic musical instrument with pedals, comprising:

first and second pedals which are able to be operated by a foot; and control means for increasing/decreasing a value of a predetermined parameter to be controlled in accordance with an operation of said first and second pedals;

wherein a relationship between the operation of said first pedal and an increase/decrease in said parameter to be controlled is set to be opposite to a relationship between the operation of said second pedal and the increase/decrease in said parameter to be controlled.

4. An electronic musical instrument with pedals comprising:

at least two pedals; and control means for switching a parameter to be controlled by each pedal according to a mode selected by a mode selection means, increasing a value of a predetermined parameter to be controlled in accordance with an operation of a first pedal in at least one of said modes, and decreasing a value of said predetermined parameter in accordance with an operation of a second pedal in said one of said modes.

5. An electronic musical instrument according to claim 4, further comprising analog-to-digital converters for converting analog values corresponding to depression amounts of said pedals into digital data, wherein said control means performs multi-stage control according to said digital data or performs ON/OFF control by comparison between said digital data and a predetermined threshold value.

6. An electronic musical instrument with a pedal, comprising:

mode selection means for selecting a mode from among plural modes;

assignment means for designating a parameter, to be controlled by the pedal, from among plural parameters according to the selected mode and assigning the designated parameter to the pedal;

detecting means for detecting a depression degree of the pedal and outputting an analog signal representing the detected depression degree;

analog-to-digital converting means for converting the outputted analog signal into a digital value corresponding thereto;

data generating means for generating a value of the designated parameter in multi-stages according to the digital value from the analog-to-digital converting means, wherein, if the digital value is the same value, the generated value for a designated parameter is different from the generated value for another designated parameter; and control means for controlling a musical tone signal, to be generated in the electronic musical instrument, based on the generated value from the data generating means.

7. An electronic musical instrument according to claim 6, wherein said parameters respectively represent changeable elements of the musical tone to be generated.

8. An electronic musical instrument according to claim 7, wherein said changeable elements are designated from among a soft-pedal element, a start/stop element, an intro/ending element, a tone volume element, a tempo element, and a tone pitch element.

9. An electronic musical instrument according to claim 1, wherein said parameter is designated from among a soft-pedal parameter, a start/stop parameter, an intro/ending parameter, a tone volume parameter, a tempo parameter, and a tone pitch parameter.

10. An electronic musical instrument according to claim 3, further comprising:

mode selection means for selecting a mode from among plural modes; and assignment means for designating a parameter from among plural parameters according to the selected mode and assigning the designated parameter to the pedals.

11. An electronic musical instrument according to claim 4, further comprising:

mode selection means for selecting a mode from among plural modes; and assignment means for designating a parameter from among plural parameters according to the selected mode and assigning the designated parameter to the pedals.

12. An electronic musical instrument with a pedal, comprising:

detecting means for detecting a depression degree of the pedal and outputting a signal representing the detected depression degree;

analog-to-digital converting means for converting the outputted signal into a digital signal corresponding thereto;

comparing means for comparing a value of the digital signal with a first threshold value and a second threshold value, and outputting a signal representing a result of comparing, wherein the first threshold value is larger than the second threshold value; and control means for deciding whether a state of the pedal is on or off based on the signal outputted by the comparing means, the control means deciding that the state has become on when the value of the digital signal becomes larger than the first threshold value in the state of off, and that the state has become off when the value of the digital signal becomes smaller than the second threshold value in the state of on, the control means also deciding that the state has not changed when the value of the digital signal becomes larger than the first threshold value in the state of on or when the value of the digital signal becomes smaller than the second threshold value in the state of off;

wherein the control means controls a musical tone signal according to the state of the pedal having a hysteresis characteristic on the change of the state thereof.

* * * * *